US009899745B2

(12) United States Patent
Chang et al.

(10) Patent No.: US 9,899,745 B2
(45) Date of Patent: Feb. 20, 2018

(54) LOW PROFILE HIGH EFFICIENCY MULTI-BAND REFLECTOR ANTENNAS

(71) Applicant: Raytheon Company, Waltham, MA (US)

(72) Inventors: Yueh-Chi Chang, Northborough, MA (US); David L. Hendry, Sudbury, MA (US); Aravind B. Movva, Marlborough, MA (US)

(73) Assignee: Raytheon Company, Waltham, MA (US)

( * ) Notice: Subject to any disclaimer, the term of this patent is extended or adjusted under 35 U.S.C. 154(b) by 120 days.

(21) Appl. No.: 14/026,446

(22) Filed: Sep. 13, 2013

(65) Prior Publication Data

US 2015/0077304 A1 Mar. 19, 2015

(51) Int. Cl.

| | |
|---|---|
| ***H01Q 19/19*** | (2006.01) |
| ***H01Q 15/16*** | (2006.01) |
| ***H01Q 5/385*** | (2015.01) |

(52) U.S. Cl.

CPC ..... *H01Q 19/19* (2013.01); *H01Q 5/385* (2015.01); *H01Q 15/16* (2013.01)

(58) Field of Classification Search

CPC ..... H01Q 5/0065; H01Q 19/19; H01Q 5/385
USPC ..... 343/837
See application file for complete search history.

(56) References Cited

U.S. PATENT DOCUMENTS

| | | | | |
|---|---|---|---|---|
| 6,262,689 | B1 * | 7/2001 | Yamamoto | H01Q 3/20 343/781 P |
| 6,603,437 | B2 | 8/2003 | Chang | |
| 6,741,216 | B2 * | 5/2004 | Inasawa | H01Q 3/08 343/754 |
| 7,408,522 | B2 * | 8/2008 | Ahn | H01Q 21/28 343/781 CA |
| 7,432,871 | B2 | 10/2008 | Milroy et al. | |
| 2003/0095075 | A1 | 5/2003 | Ramanujam et al. | |
| 2003/0210202 | A1 * | 11/2003 | Desargant | H01Q 1/28 343/837 |
| 2005/0200547 | A1 | 9/2005 | Naito et al. | |
| 2008/0004298 | A1 | 1/2008 | Bolli et al. | |
| 2012/0013516 | A1 * | 1/2012 | Ahn | H01Q 19/19 343/779 |

OTHER PUBLICATIONS

Vesnik; "On the Possibility of the Application of Axially Displaced Ellipse Antenna Elements for Construction of a Compact Multibeam Antenna System;" IEEE Antennas and Propagation Magazine; vol. 53; No. 2; Apr. 2011; pp. 125-128.

PCT Search Report of the ISA for Appl. No. PCT/US2014/051649 dated May 4, 2015.

Written Opinion of the ISA for Appl. No. PCT/2014/051649 dated May 4, 2015.

Chang, et al.; "A Milstar Low Profile Antenna;" IEEE; Antennas and Propagation Society International Symposium; vol. 1; Jan. 1999; pp. 684-687.

(Continued)

*Primary Examiner* — Dameon E Levi

*Assistant Examiner* — Walter Davis

(74) *Attorney, Agent, or Firm* — Daly, Crowley, Mofford & Durkee, LLP

(57) ABSTRACT

An antenna comprising a reflector have a center-fed shaped axially displaced elliptical (ADE) configuration with either an elliptical aperture or a truncated elliptical aperture is described.

14 Claims, 9 Drawing Sheets

(56) References Cited

OTHER PUBLICATIONS

Chang, et al.; "Synthesis and Analysis of Shaped Ade Reflectors By Ray Tracing;" Antennas and Propagation Society International Symposium; vol. 2; Jun. 18-23, 1995; pp. 118201185.
Liefer, et al.; "Grasp: An Improved Displaced-Axis, Duel-Reflector Antenna Design for EHF Applications;" IEEE; Antennas and Propagation Society International Symposium; vol. 24; Jun. 8-13, 1986; pp. 507-510.
ThinKom Solutions Inc.; Thin-Kom's Dual-Band CTS Flatplate FAB-T Large Aircraft Antenna (LAA) is 45% Smaller than Competitive Approaches—Presentation Page—Jan. 2011.
Yerukhimovich; "Analysis of Two-Mirror Antennas of General Type;" Telecommun. Radio Eng; Jan. 1972; pp. 97-103.
New Zealand First Examination Report for New Zealand Appl. No. 814280 dated Jul. 11, 2016; 4 pages.
Response to Examination Report for Australian Appl. No. 2014332522 dated Sep. 12, 2016; 25 pages.
Response to New Zealand First Examination Report dated Jul. 11, 2016 for New Zealand Appl. No. 714280 as filed Dec. 9, 2016; 59 pages.
Examination Search Report dated Dec. 12, 2016 for Canadian Application No. 2,912,541; 3 Pages.
Taiwanese Office Action and translation dated Feb. 17, 2016 for Taiwan Appl. No. 103129555; 12 pages.
International Preliminary Report on Patentability dated Mar. 24, 2016 for PCT App. No. PCT/US2014/051649; 8 pages.
Examination Report dated Apr. 12, 2016 for Australian App. No. 2014332522; 3 pages.
Response to Office Action with English claims dated May 17, 2016 for Chinese App. No. 103129555; 8 pages.
New Zealand Third Examination Report for Application No. 714280 dated Mar. 27, 2017; 1 page.
Response to Canadian Examination Report dated Dec. 12, 2016 for Canadian Appl. No. 2,912,541 as filed on Feb. 24, 2017; 9 pages.
New Zealand Second Examination Report for New Zealand Application No. 714280 dated Jan. 19, 2017; 2 pages.
Response to the Second New Zealand Examination Report dated Jan. 19, 2017 for New Zealand Appl. No. 714280 as filed on Mar. 1, 2017; 29 pages.
Canadian Examination Report dated Aug. 14, 2017 from Application No. 2,912,541; 4 Pages.
European Examination Report dated Aug. 25, 2017 from Application No. GB1602474.7; 6 Pages.

* cited by examiner

LOW PROFILE HIGH EFFICIENCY MULTI-BAND REFLECTOR ANTENNAS

GOVERNMENT INTERESTS

This invention was made with Government support under FA8620-11-G-4025, awarded by the Department of Defense. The Government has certain rights in this invention.

FIELD

The concepts, systems, circuits and techniques described herein relate generally to radio frequency (RF) subsystems and more particularly to microwave and millimeter-wave antennas.

BACKGROUND

As is known in the art, there is a need for low profile high efficiency multi-band antennas for satellite communication (SATCOM) on aircraft, ships, and vehicles. Many, if not most conventional SATCOM antennas have circular apertures and the height of radomes covering the antennas is sometimes significantly greater than is desirable.

In aircraft applications, for example, it is desirable to utilize antenna and radomes having a low profile to reduce drag. In ship and ground-based vehicle applications, a low profile antenna can be desirable to reduce observability. For these applications, low profile antennas having high efficiency are very desirable.

Furthermore, since various satellites operate in different frequency bands, it is desirable for SATCOM antennas to be capable of operating multiple different frequency bands. Multi-band antennas capable of operating over two or three different frequency bands reduces the number of antennas needed for communication with various satellites which operate in different frequency bands. Thus, the use of antennas capable of multi-band operation reduces both the total system cost and the space needed for the antennas.

Existing so-called low profile antennas for SATCOM applications either have a large swept volume, or operate only at single frequency band resulting in systems having a high cost, or having low antenna efficiency.

SUMMARY

The use of Axially Displaced Elliptical (ADE) reflectors as well as shaped ADE circular reflectors to achieve high antenna aperture efficiency has been well documented as described in: Y. A. Erukhimovich, "Analysis of Two-Mirror Antenna of a General Type", Telecom and Radio Engineering, Part 2, No. 11, page 97-103, 1972; A. C. Leifer and W. Rotman; "GRASP: An Improved Displaced-Axis, Dual-Reflector Antenna Design for EHF Applications", 1986 APS Symposium, Philadelphia, pp. 507-510; and Y. Chang and M. Im, "Synthesis and Analysis of Shaped ADE Reflectors by Ray Tracing", 1995 IEEE antenna and propagation symposium, pp. 1182-1185.

Shaped ADE designs allow a subreflector to capture most of the energy radiated from a feed and distributed it over a circular reflector aperture fairly uniformly, thus increasing (or ideally maximizing) the illumination efficiency while minimizing the spillover loss.

In accordance with the concepts, systems and techniques described herein, various configurations of low profile multi-band antennas for satellite communications (SATCOM) applications having high antenna efficiencies and which can be produced using low cost manufacturing techniques are herein described. Such antennas include one or more reflectors having a center-fed shaped axially displaced elliptical (ADE) configuration with either an elliptical aperture or a modified elliptical aperture.

Use of one or more reflectors having a center-fed shaped ADE configuration with either an elliptical aperture or a modified elliptical aperture leads to a low profile, minimum swept volume, high efficiency multi-band reflector antenna.

In one embodiment, two such elliptical ADE reflector antennas can be adjacently mounted to thereby substantially double or substantially have an aspect ratio of a reflector aperture. Furthermore, adjacently mounting two (or more) elliptical ADE antennas provides an antenna capable of monopulse operation. The monopulse capability provided by such an arrangement results in higher tracking accuracy and correspondingly lower pointing loss, compared to conventional systems which utilize methods such as gimbal scan. In one exemplary embodiment (to be described in detail below in conjunction with FIGS. 2 and 3), an antenna is provided from two reflector-antennas disposed in a side-by-side arrangement which substantially doubles an aspect ratio (long vs. short) of antenna aperture dimensions. Such a side-by-side arrangement provides a monopulse capability in an azimuth direction, where the beamwidth is much narrower than the beamwidth in the elevation direction. The monopulse capability provided by such an arrangement achieves higher tracking accuracy and correspondingly lower pointing loss, compared to other systems which utilize methods such as gimbal scan.

With an antenna provided from adjacent reflector-antenna configurations (e.g. side-by-side antenna configurations), there are open areas where there are no reflector surfaces, although each antenna has an optimized aperture distribution by itself (i.e. when considered individually. Consequently, a tradeoff study between antenna aperture size and efficiency was made and resulted in a design utilizing two reflector-antennas which when placed together result in an antenna having an antenna aperture size larger than that which would fit within a specified volume (set, in part, by a radome size). Consequently, an antenna is provided from reflector-antennas modified to fit within the specified volume. In one exemplary embodiment, the reflector-antennas were truncated on a side and the reflector-antennas were arranged such that the resulting truncated sides were placed in contact with each other. This truncation approach, resulted in an antenna having a large overall antenna aperture size while maintaining high efficiency within a specified volume. In addition to increasing antenna aperture area to increase (and ideally) maximize antenna gain by placing two truncated elliptical ADE reflector-antennas side by side, arranging two truncated elliptical ADE reflector-antennas side by side also provides a monopulse tracking capability as described above.

In accordance with a further aspect of the concepts, systems and techniques described herein, it is recognized that since an elliptical ADE reflector is a relatively broadband device, the limit on the number of frequency bands over which the elliptical ADE reflector antenna can operate is determined by the antenna feed design and performance. Concentric multi-band feeds that operate either with two or three frequency bands can be used with the elliptical ADE reflectors to become multi-band antennas without increasing an overall system footprint. There are several examples of such multi-band feeds with co-located phase centers and approximately equal 10-dB beamwidths for all bands.

BRIEF DESCRIPTION OF THE DRAWINGS

The foregoing and other objects, features and advantages of the concepts, systems and techniques described herein will be apparent from the following description of particular embodiments, as illustrated in the accompanying drawings in which like reference characters refer to the same parts throughout the different views. The drawings are not necessarily to scale, emphasis instead being placed upon illustrating the principles of the concepts, systems, circuits and techniques for which protection is sought.

DETAILED DESCRIPTION

Figure 1:
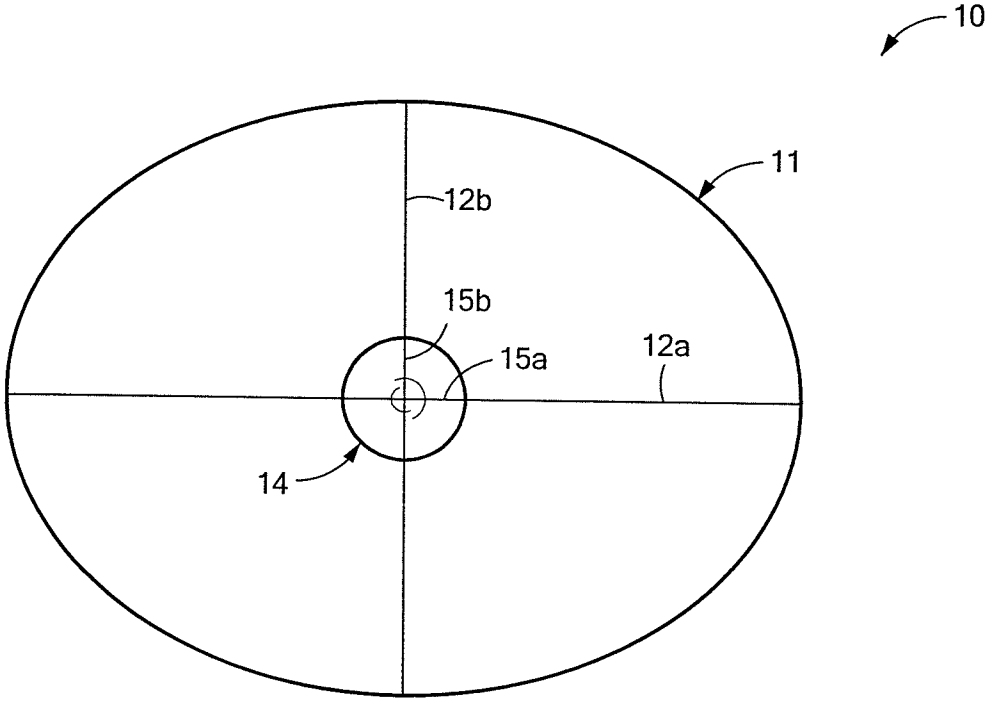
FIG. 1 is a front view of an elliptical axially displaced elliptical (ADE) reflector antenna.

Before proceeding with a discussion of shaped axially displaced elliptical (ADE) reflectors and reflector antennas, some introductory concepts and terminology are explained. Described herein are various configurations of low profile multi-band antennas for satellite communication (SATCOM) applications having high antenna efficiencies and which can be manufactured using low cost manufacturing techniques. Such antennas include a reflector having a center-fed shaped axially displaced elliptical (ADE) configuration with either an elliptical aperture or a modified elliptical aperture such as a truncated elliptical aperture, for example.

Exemplary embodiments described herein are directed toward an antenna system comprised of one or more elliptical ADE reflector-antennas (or more simply "ADE reflectors"). It should be noted that reference is sometimes made herein to an antenna system having a particular number of reflectors. It should of course, be appreciated that an antenna system comprising elliptical ADE reflectors may include any number of elliptical ADE reflectors and that after reading the description provided herein, one of ordinary skill in the art will appreciate how to select the particular number of reflectors to use in any particular application.

It should also be noted that reference is sometimes made herein to an antenna having a particular shape or physical size or operating in a particular frequency band or particular frequency bands. One of ordinary skill in the art will appreciate that the concepts and techniques described herein are applicable to various sizes and shapes of antennas (including arrays of elliptical ADE reflectors) and that any number of elliptical ADE reflectors may be used and that one of ordinary skill in the art will appreciate how to select the particular sizes, shapes of number of elliptical ADE reflectors to use in any particular application and that such antenna utilizing such reflectors are capable of operation over a wide range of frequencies and among and different frequency bands.

Similarly, reference is sometimes made herein to an antenna having a particular geometric shape and/or size (or a particular spacing or arrangement of elliptical ADE reflectors antenna elements). One of ordinary skill in the art will appreciate that the techniques described herein are applicable to various sizes and shapes of elliptical ADE reflectors.

Also, the elliptical ADE reflectors may be arranged as one or two dimensional arrays in a variety of different lattice arrangements including, but not limited to, periodic lattice arrangements or configurations (e.g. rectangular, circular, equilateral or isosceles triangular and spiral configurations) as well as non-periodic or other geometric arrangements including arbitrarily shaped array geometries.

In one embodiment, a synthesis technique has been applied to provide shaping technique used to provide elliptical ADE reflectors having a low profile. Examples of such elliptical ADE reflectors are described below in conjunction with FIGS. 1-4. Briefly, the synthesis technique utilizes piecewise ray tracing following Snell's law. Both energy conservation and equal path lengths for ray tracing are preserved to ensure high illumination efficiency without loss due to phase variation.

Figure 2:
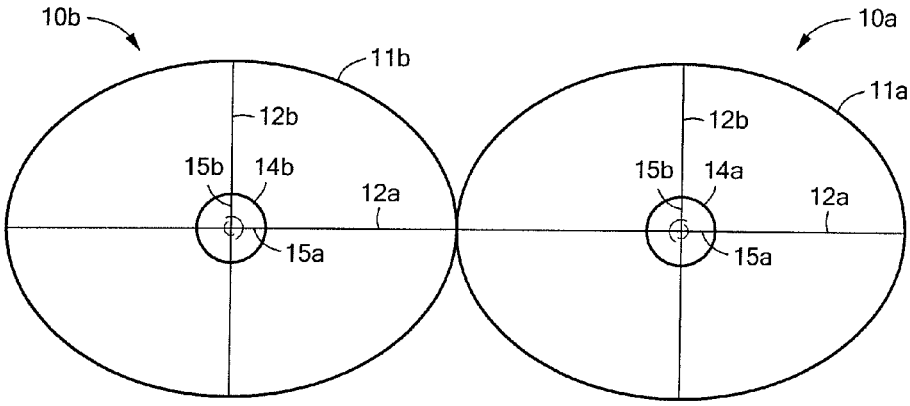
FIG. 2 is a front view of an antenna system provided from two side-by-side elliptical ADE reflector antennas.
Figure 3:
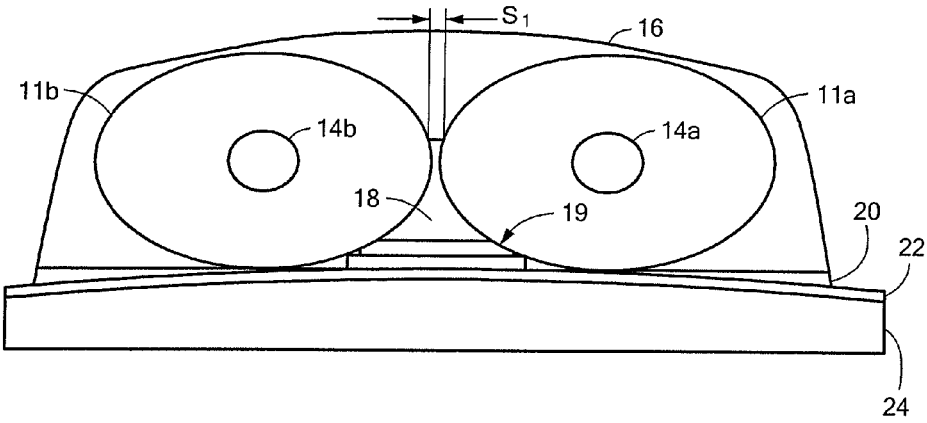
FIG. 3 is a front view of an antenna assembly comprising an antenna system provided from two side-by-side elliptical ADE reflectors.

Referring now to FIGS. 1-3 in which like elements are provided having like reference designations throughout the several views, an antenna 10 includes a main reflector 11 and a sub-reflector 14 disposed about the main reflector. In the exemplary embodiment of FIGS. 1-3, main reflector 11 is provided having an elliptical shape with a major axis 12*a* and a minor axis 12*b* and sub-reflector 14 is also provided having an elliptical shape with a major axis 14*a* and a minor axis 14*b*. Antenna 10 further includes a center feed (not visible in FIGS. 1-3).

Thus, antenna 10 corresponds to an elliptical axially displaced elliptical (ADE) reflector antenna having a center-fed shaped ADE configuration with either an elliptical aperture or a modified elliptical aperture. Other shapes are also possible, in embodiments which use an elliptical aperture, a wide range of aspect ratios may be used, but aspect ratios below 2:1 are preferred for a single elliptical reflector. It should, of course, be appreciated (and as will become apparent from the description hereinbelow) that both the reflector and the sub-reflector need not be provided having an elliptical shape.

Figure 7:
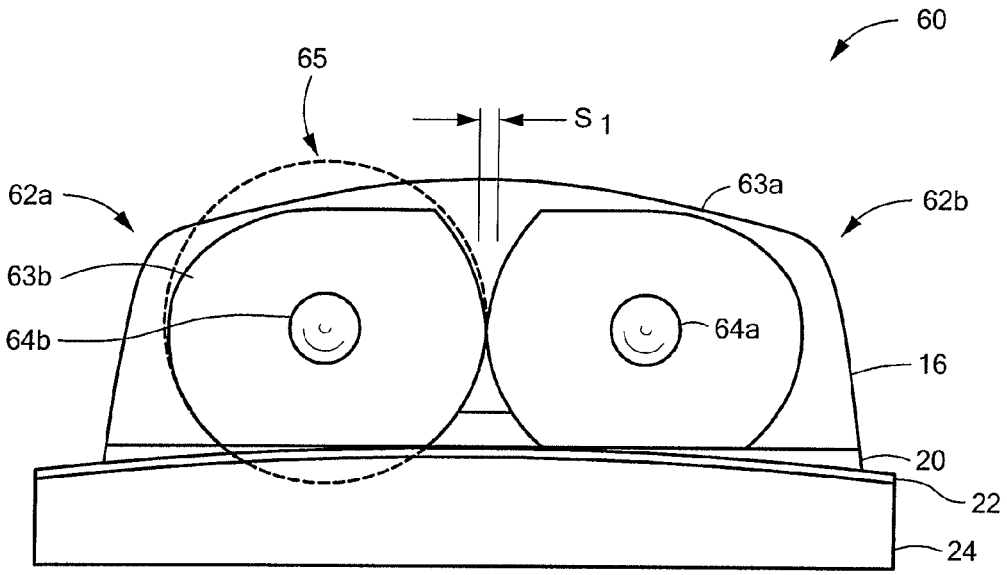
FIG. 7 is a front view of an antenna assembly comprising an antenna system provided from two side-by-side truncated elliptical ADE reflector antennas.

As will become apparent from the description provided hereinbelow, antenna 10 may provided having either an elliptical aperture (FIGS. 1-3), a modified elliptical aperture (FIG. 4) or a modified circular aperture (FIG. 7).

Referring now to FIGS. 2 and 3, an antenna system comprises a pair of elliptical ADE reflector antennas 10*a*, 10*b* each of which may be the same as or similar to elliptical ADE antenna 10 in FIG. 1 are adjacently disposed. In the exemplary embodiment of FIGS. 2 and 3, the elliptical reflectors 10*a*, 10*b* are disposed in a side-by-side arrangement with the major axis 12*a* of each main reflector 11*a*, 11*b* aligned. Also, the major axis 15*a* of each sub-reflector 14*a*, 14*b* is aligned. In the exemplary embodiment of FIGS. 2 and 3, this side-by-side configuration doubles the aspect ratio of long vs. short aperture dimensions.

In this exemplary embodiment, two reflectors 10*a*, 10*b* are positioned side by side touching each other without any separation (S1=0). From RF performance point of view, any separation other than nothing will waste useful area under the radome, so mechanical design and manufacturing efforts should be taken to make it zero (i.e. a distance of S1=0 is preferred). It is desirable to have uniform illumination over the entire aperture and the truncating approach described herein affords the ability to provide an antenna having a relatively large overall aperture for a given antenna footprint. In most embodiments, edges of reflectors 12*a*, 12*b* may touch (i.e. S1=0) while in other embodiments edges of reflectors 12*a*, 12*b* may be spaced apart due to other mechanical considerations.

An adjacent configuration also provides a monopulse capability. For example, the exemplary side-by-side configuration shown in FIGS. 2 and 3 provides a monopulse capability in the azimuth direction, where the antenna beamwidth is much narrower than antenna beam width in the elevation direction. A monopulse capability provides the antenna having a higher tracking accuracy and correspondingly lower pointing loss, compared to other systems such as systems employing a gimbal scan technique. It should be appreciated that an antenna system could also be provided as a linear array (e.g. N×1 array) for example by placing three (or more) reflectors side-by-side. This technique would further increase the aspect ratio. For example one could use 3×1, 4×1 or even 5×1 with major axes aligned to extend the aspect ratio, but such an approach may not be appropriate for monopulse operation. It is also possible to have planar array configurations (e.g. a 2×2 configuration). This would result in an antenna system having a low profile and monopulse capabilities in both AZ and EL directions.

It should be noted that antennas may be adjacently disposed in other configurations (e.g. with the minor axis of both antennas aligned or with a minor axis of one antenna aligned with a major axis of another antenna or with cardinal axis of two antennas aligned.

As may be most clearly seen in FIG. 3, antennas 10*a*, 10*b* are disposed over a base 24 and a radome 16 is disposed over the antennas 10*a*, 10*b* are coupled to a support structure 18 coupled to a movable pedestal 19 which may, for example, be provided as an elevation over azimuth pedestal (el/az pedestal). A radome 16 is disposed over antennas 10*a*, 10*b* and is coupled through a mounting plate 20 on which the antennas 10*a*, 10*b* are mounted. Plate 20 is coupled to a platform 22 having an interior platform portion 24.

In the side-by-side arrangement illustrated in FIGS. 2 and 3, each antenna has an optimized aperture distribution when considered alone. However, as evident from FIGS. 2 and 3, antenna embodiments which comprise a plurality of adjacently disposed elliptical ADE reflector antennas, areas exist where there are no reflector surfaces (i.e. there are so-called open areas). To reduce such open areas where there are no reflector surfaces, a pair of modified elliptical ADE reflector antennas may be used as illustrated in FIG. 4.

Figure 4:
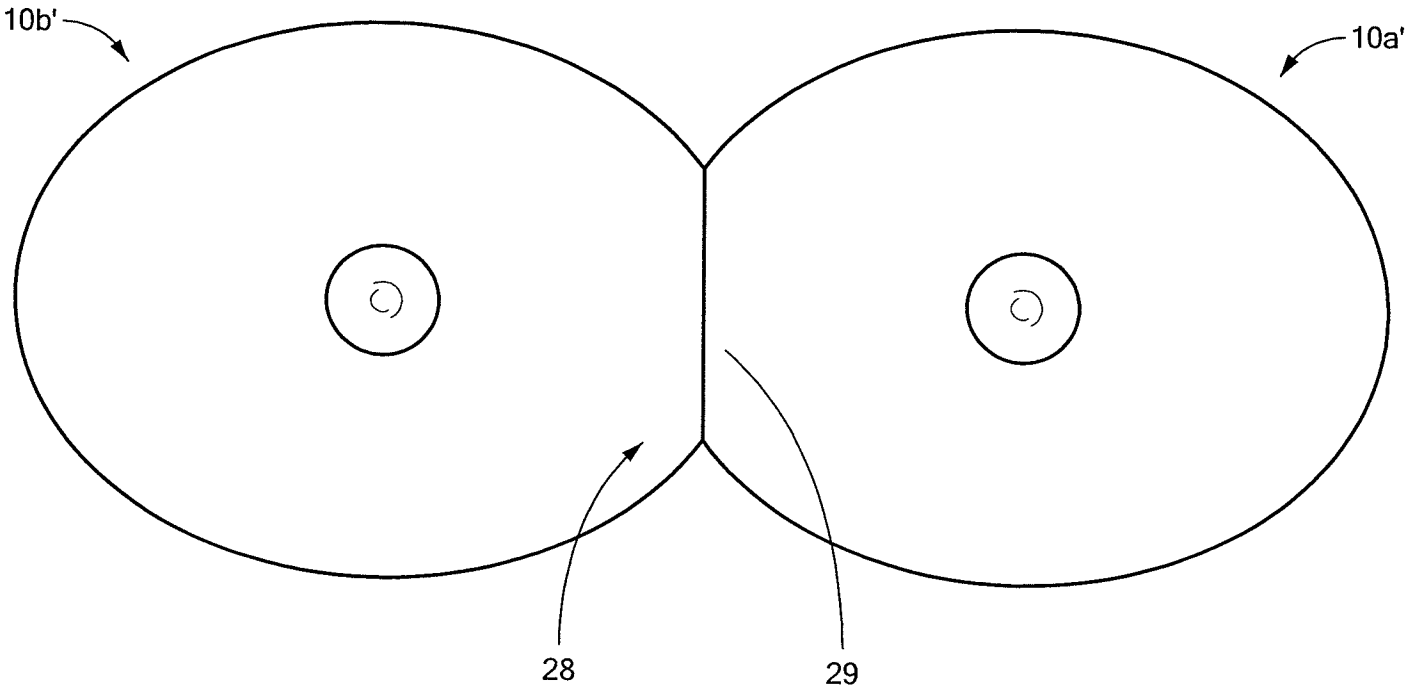
FIG. 4 is a front view of an antenna system provided from two truncated side-by-side elliptical ADE reflector antenna.

Referring now to FIG. 4, an antenna comprises of a pair of modified elliptical ADE reflector antennas 10*a*', 10*b*' adjacently disposed with a major axis of each antenna reflector and sub reflector aligned. In the exemplary embodiment of FIG. 4, the elliptical ADE reflector antennas 10*a*', 10*b*' are modified by truncating one side of each antenna 28, 29 and arranging the antennas such that the resulting truncated sides are placed in contact with each other (designated by reference numeral 30 in FIG. 4). To decide how much to truncate, an elliptical aperture with fairly uniform energy distribution over the entire aperture is designed. Since it has been recognized in accordance with the concepts described herein that truncation will cause both area loss and energy loss, to degrade the overall antenna efficiency, a tradeoff analysis is required to determine a desired (and ideally optimized) aperture shape by selecting various configurations and analyzing all cases to determine which one is the best for a particular application. A variety of factors are considered, including but not limited to sidelobe degradation caused by the truncation. Energy which misses the reflector due to truncation becomes spillover lobes which tend to be fairly high and may not be acceptable in some applications due to sidelobe level requirements. It is preferred that the truncated sides 28, 29 be in physical contact with each other. However, in the case where a gap exists between the reflectors, a conductor may be used to "fill in" the gap to thus provide the appearance of a continuously conductive surface.

In the exemplary embodiment of FIG. 4, the main reflector is truncated by removing a portion of the main reflector along a direction which is transverse to a major axis of said main reflector. It should be appreciated, however, that one can truncate either or both sides of each ellipse (e.g. such that symmetrically truncated or asymmetrically ellipses are provided).

Figure 8:
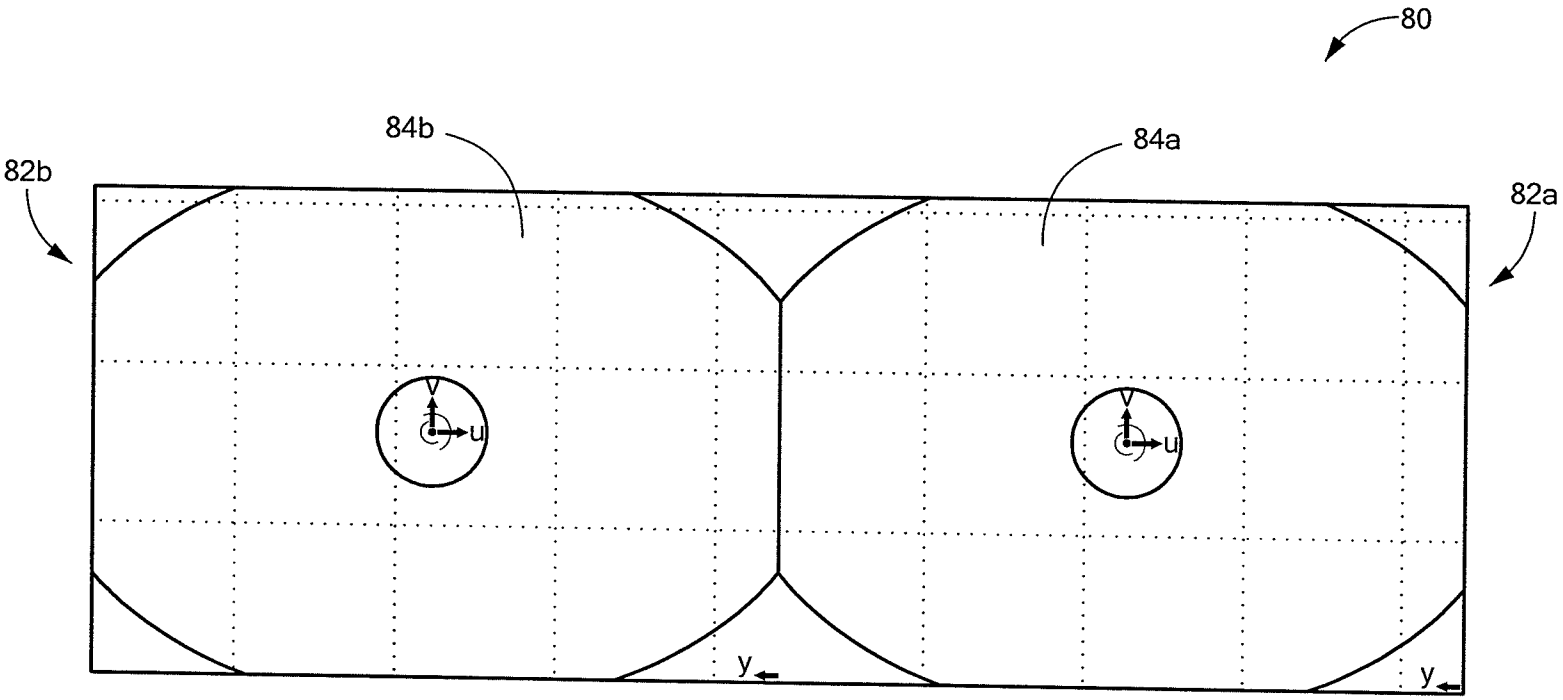
FIG. 8 is a front view of an alternate embodiment of an antenna system provided two side-by-side truncated elliptical ADE reflector antennas.

It should be appreciated, however, that the main reflector may also be truncated by removing a portion of the main reflector along a direction which is parallel to the major axis of said main reflector (e.g. the antennas may also be modified by truncating top and/or bottom portions of the reflector) as shown in the exemplary embodiments of FIG. 7 and FIG. 8.

It should be noted that modified (e.g. truncated) elliptical IDE reflector antennas may be adjacently disposed in other configurations (e.g. with both minor axis aligned or with a minor and major axis aligned or with cardinal axis aligned. It should thus be appreciated that an antenna system could also be provided as a linear array (e.g. N×1 array) for example by placing three (or more) truncated reflectors side-by-side. This technique would further increase the aspect ratio. For example one could use 3×1, 4×1 or even 5×1 with major axes aligned to extend the aspect ratio, but such an approach may not be appropriate for monopulse operation. It is also possible to have planar array configurations (e.g. a 2×2 configuration). This would result in an antenna system having a low profile and monopulse capabilities in both AZ and EL directions.

A tradeoff study has been conducted to generate an antenna system provided from two reflector-antennas having larger aperture sizes such that the antennas do not fit within a volume allowed by the size of a radome (e.g. radome 16 in FIG. 3). Thus, the antennas are truncated or otherwise modified to fit within a limited radome volume. By "truncating" or otherwise modifying portions of the elliptical ADE reflector antenna, a larger overall antenna aperture size is achieved while maintaining high efficiency within the limited radome volume.

It should further be appreciated that since a reflector is a broadband device, the limit on the number of frequency bands over which the reflector can operate is determined, at least in part, by the antenna feed circuit (also referred to as a "feed circuit" or more simply a "feed"). Concentric multi-band feeds capable of operation over multiple frequency bands (e.g. over two or three frequency bands) can be used with the reflectors to provide multi-band antennas without increasing an overall "footprint" of an antenna system. There are several examples of such multi-band feeds with co-located phase centers and approximately equal 10-dB beam widths for all bands.

The pair of truncated elliptical antennas adjacently disposed with a major axis of each antenna aligned provides monopulse tracking capability in an azimuth direction. Placing the two truncated antennas side-by-side, increases aperture area to increase (and ideally maximize) antenna gain. It should be noted that in the case were the minor axes of the reflectors are aligned, the pair of side-by-side antennas provide monopulse capability in the elevation direction.

Figure 5:
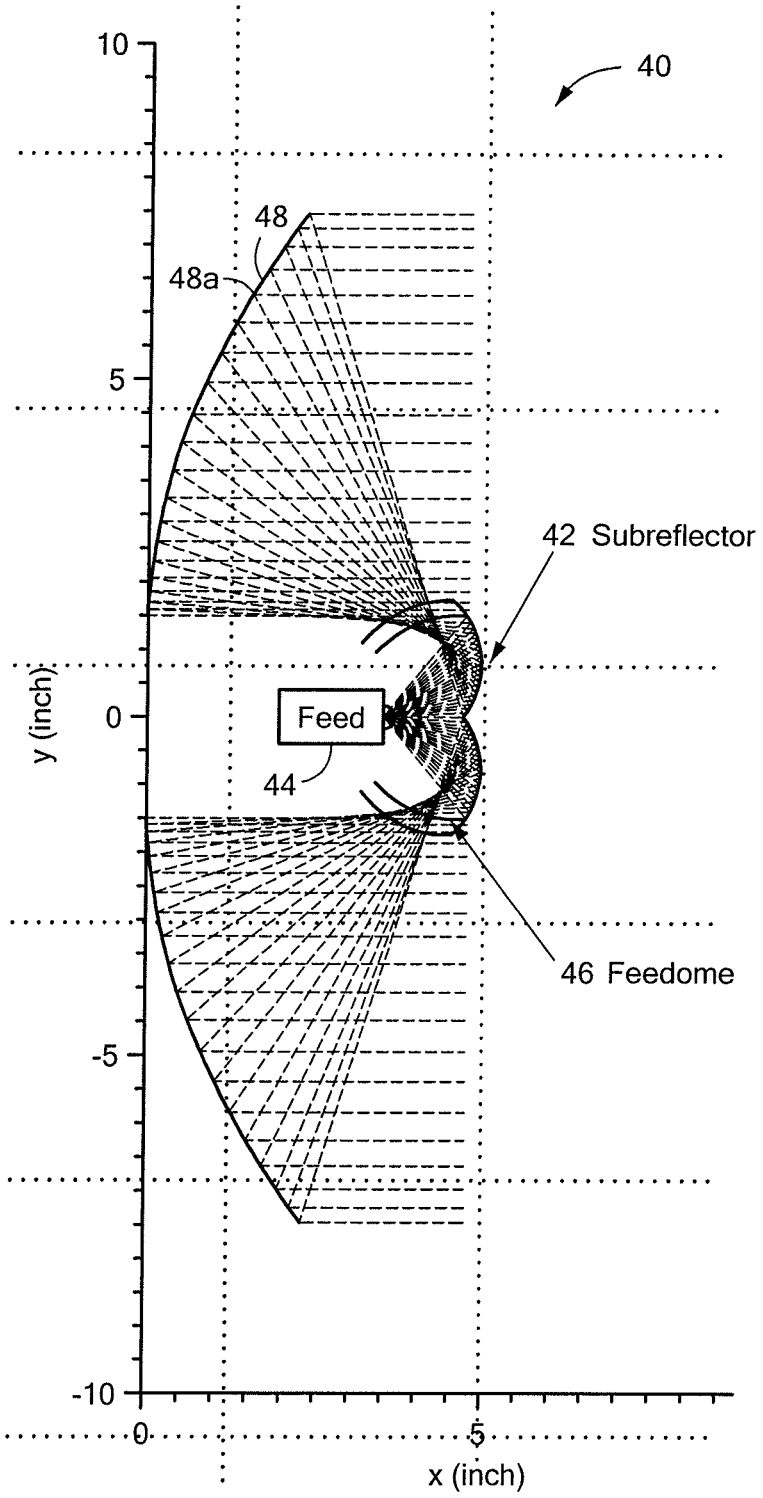
FIG. 5 is a side ray-tracing view of an elliptical ADE reflector antenna where the dashed lines trace the energy (ray) from the feed to the subreflector and main reflector then into free space.

Referring now to FIG. 5, an antenna 40 includes a subreflector 42, a feed 44 and a feedome 46. As indicated by the piecewise ray tracing, RF energy is radiated from feed 44 to the sub-reflector 42 and subsequently to a surface 48*a* of the main reflector 48. In one embodiment, shaping has been use to generate elliptical ADE reflectors having a low profile. Briefly, the shaping technique utilizes piecewise ray tracing following Snell's law. Both energy conservation and equal path lengths for ray tracing are preserved to ensure high illumination efficiency without loss due to phase variation.

Figure 6:
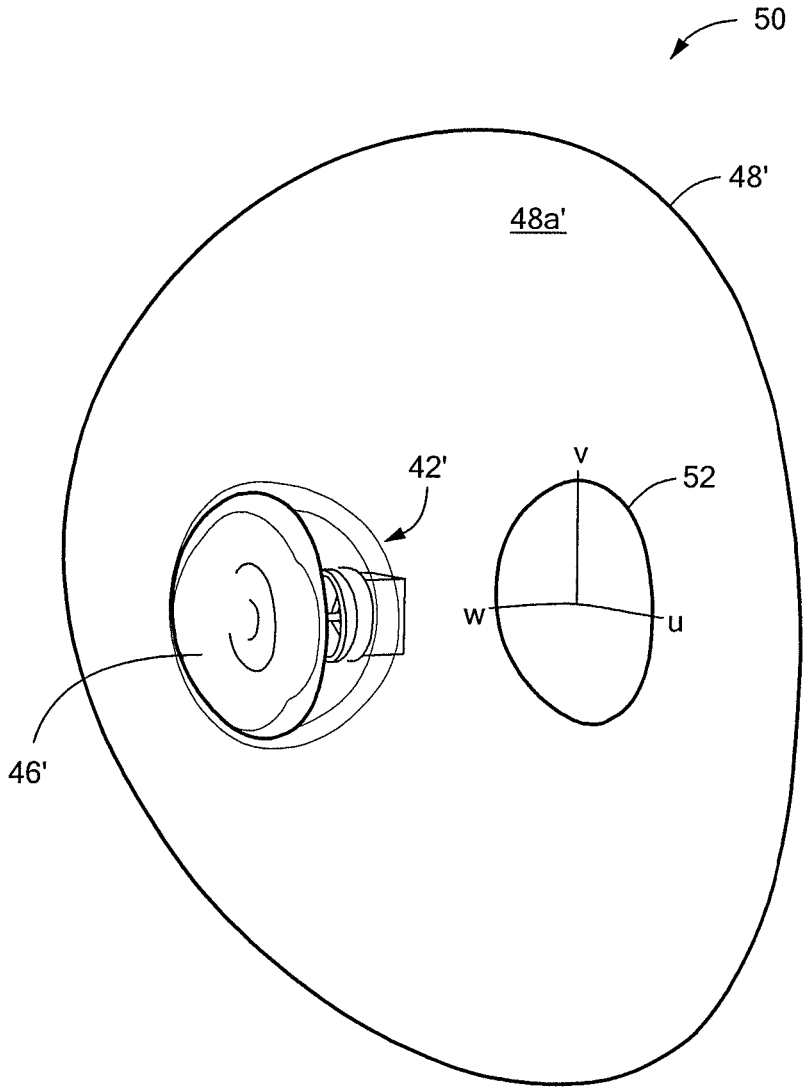
FIG. 6 is an isometric view of an elliptical ADE reflector antenna.

Referring now to FIG. 6, an antenna 50 which may be the same as or similar to antenna 40 described in conjunction with FIG. 5 includes a subreflector 42', a feed 44' and a feedome 46'. Reference numeral 52 represents a blockage area on main reflector 48. From the ray-tracing chart in FIG. 5, one can see that there is no energy illuminating that area, which is about the same size of the subreflector but typically is made a little bit smaller. The hole provides room for the feed and other components, as shown for example in FIG. 10.

Referring now to FIG. 7 (see revised FIG. 7), in which like elements of FIG. 3 are provided having like reference designations, an antenna assembly 60 includes a pair of modified reflector antennas 62*a*, 62*b* disposed in a side-by-side arrangement. Main reflectors 63*a*, 63*b* are here provided having a modified circular shape. For reference, an original circular ADE shape 65 is included in phantom since it is not part of antenna system 60. In this exemplary embodiment an antenna gain characteristic across all bands is improved (compared with prior art systems) and, ideally, the antenna gain characteristic across all bands is optimized. In other embodiments, such an antenna assembly may be provided as a one-dimensional array (i.e. a linear array) or a two-dimensional (e.g. a 2×2 array) and in the two-dimensional case, any lattice pattern can be used.

In this exemplary embodiment, the antennas 62*a*, 62*b* are spaced apart by a distance S1. In most preferred embodiments, edges of main reflectors 63*a*, 63*b* may touch (i.e. S1=0) while in other embodiments edges of main reflectors 63*a*, 63*b* may be spaced apart by an amount selected due to mechanical constraints.

As noted above, an adjacent configuration also provides a monopulse capability (for example, a monopulse capability in a azimuth direction, where the antenna beamwidth is much narrower than antenna beam width in an elevation direction). A monopulse capability provides the antenna having a higher tracking accuracy and correspondingly lower pointing loss, compared to other systems such as systems employing a gimbal scan technique.

Referring now to FIG. 8, an alternate embodiment of an antenna system 80 includes two side-by-side truncated elliptical ADE reflector antennas 82*a*, 82*b*. In this exemplary embodiment, main reflectors 84*a*, 84*b* have been truncated at top, bottom, left-side and right-side portions. This may be done, for example, so that antenna system 80 fits within a given space.

As noted above, elliptical ADE reflector antennas such as elliptical ADE reflector antennas 82*a*, 82*b* in FIG. 8 may be truncated in a variety of different regions and in different amounts to provide main reflectors having a variety of different shapes. One of ordinary skill in the art, after reading the disclosure provided herein will understand what portions of main reflectors to truncate for a particular application.

Figure 9:
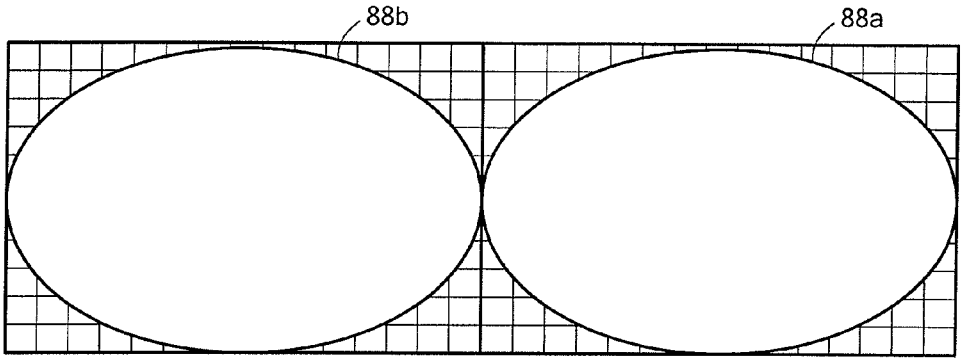
FIGS. 9-9B are a series of front views which illustrate a trade-off between antenna system aperture size and amount of truncation for an antenna system provided from two side-by-side truncated elliptical ADE reflector antennas.
Figure 9A:
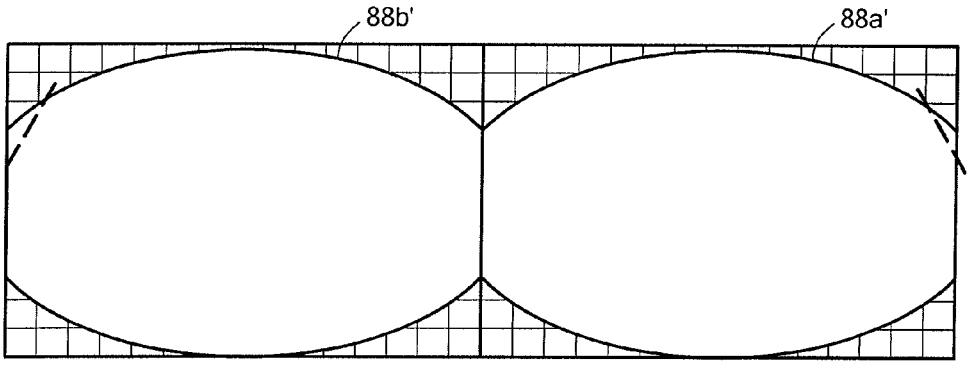
Figure 9B:
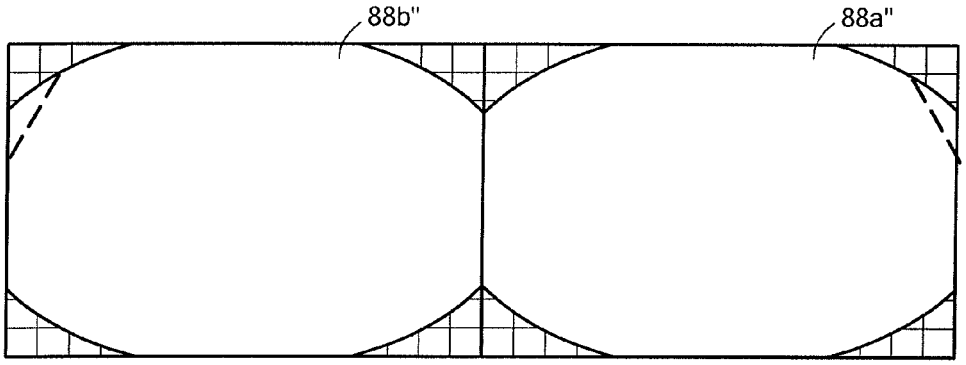

FIGS. 9-9B, for example, are a series of front views which illustrate a trade-off between antenna system aperture size and amount of truncation for an antenna system provided from two side-by-side truncated elliptical ADE reflector antennas. In FIG. 9 main reflectors 88*a*, 88*b* are provided having a full elliptical shape (i.e. a non-truncated elliptical shape), while in FIG. 9A, side portions of reflectors 88*a'*, 88*b'* have been truncated. In FIG. 9B, top, bottom and side portions of reflectors 88*a"*, 88*b"* have been truncated. It can be seen by comparing FIG. 9 to FIGS. 9A and 9B that by "truncating" or otherwise modifying portions of an elliptical ADE reflector antenna (and in particular the main reflectors of elliptical ADE reflector antennas), the antenna is provided having a larger overall antenna aperture size while maintaining high efficiency within a limited volume (e.g. a limited radome volume).

Figure 10:
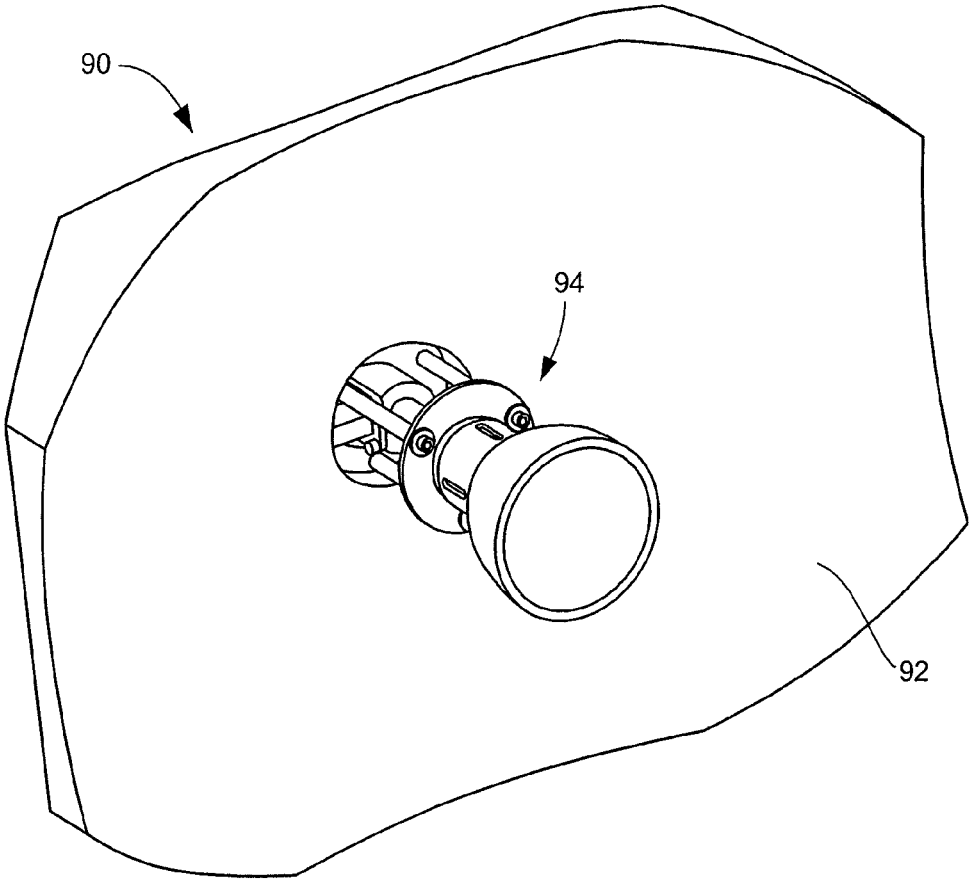
FIG. 10 is an isometric view of a truncated elliptical ADE reflector antenna.

FIG. 10 is an isometric view of a truncated elliptical ADE reflector antenna 90 comprising a truncated main reflector 92 and having a feed 94. Feed 94 may be provided, for example, as a concentric multi-band feed operating over a plurality of frequency bands can such that in cooperation with the elliptical ADE reflector, antenna 90 operates as a multi-band antenna without increasing an overall system footprint. It should be appreciated that in this exemplary embodiment, main reflector 92 is truncated on top, bottom, left and right sides.

While particular embodiments of the concepts, systems and techniques have been shown and described, it will be apparent to those skilled in the art that various changes and modifications in form and details may be made therein without departing from the spirit and scope of the concepts, systems and techniques described herein. For example, it should be noted that antennas may be adjacently disposed in configurations other than those specifically described herein (e.g. with the minor axis of both antennas aligned or with a minor axis of one antenna aligned with a major axis of another antenna or with cardinal axis of two antennas aligned). As another example, in the side-by-side arrangement illustrated in FIGS. 2 and 3 each antenna has an optimized aperture distribution when considered alone. However, as evident from FIGS. 2 and 3, antenna embodiments which comprise a plurality of adjacently disposed elliptical ADE reflector antennas, areas exist where there are no reflector surfaces (i.e. there are so-called open areas). To reduce such open areas where there are no reflector surfaces, a pair of modified elliptical ADE reflector antennas may be used as illustrated in FIG. 4. Other combination or modifications are also possible all of which will be readily apparent to one of ordinary skill in the art after reading the disclosure provided herein.

It is felt, therefore that the concepts, systems and techniques described herein should not be limited by the above description, but only as defined by the spirit and scope of the following claims which encompass, within their scope, all such changes and modifications.

The invention claimed is:

1. An antenna comprising:

a first main reflector having an elliptical shape;

a first axially displaced elliptical (ADE) sub-reflector disposed above a first surface of said first main reflector, said first sub-reflector providing a center-feed for said first main reflector; and a first feed disposed proximate said first ADE sub-reflector such that RF signals emitted from said first feed reflect from a surface of said first ADE sub-reflector and impinge upon a surface of said first main reflector;

a second main reflector having an elliptical shape;

a second axially displaced (ADE) sub-reflector disposed above a first surface of said second main reflector, said second sub-reflector providing a center-feed for said second main reflector; and a second feed circuit disposed proximate said second ADE sub-reflector such that RF signals emitted from said second feed circuit reflect from a surface of said second ADE sub-reflector and impinge upon a surface of said second main reflector;

wherein said first and second ADE sub-reflectors are disposed such that a major axis of said first ADE sub-reflector is aligned with a major axis of said second ADE sub-reflector.

2. The antenna of claim 1 wherein said first main reflector is provided having an aperture with a full elliptical shape.

3. The antenna of claim 1 wherein said first main reflector is provided having an aperture with a truncated elliptical shape.

4. The antenna of claim 3 wherein said first main reflector is truncated by removing at least a portion of said first main reflector along a direction which is transverse to a major axis of said first main reflector.

5. The antenna of claim 3 wherein said first main reflector is truncated by removing at least a portion of said first main reflector along a direction which is parallel to a major axis of said first main reflector.

6. The antenna of claim 1 wherein said first ADE sub-reflector is provided having an elliptical shape.

7. The antenna of claim 1 wherein the apertures of said first and second main reflectors are each provided having a full elliptical shape.

8. The antenna of claim 1 wherein the apertures of said first and second main reflectors are each provided having a modified elliptical shape.

9. The antenna of claim 1 wherein apertures of said first and second main reflectors are each provided having a truncated elliptical shape.

10. The antenna of claim 1 wherein said first and second main reflectors are disposed such that a major axis of said first main reflector is aligned with a major axis of said second main reflector.

11. An antenna comprising: a plurality of sub-reflectors, each of said plurality of sub-reflectors having a center-fed shaped axially displaced elliptical (ADE) configuration wherein each of said plurality of sub-reflectors is provided having an aperture having a generally elliptical shape and a plurality of feed circuits, each of said feed circuits coupled to a corresponding one of said plurality of sub-reflectors;

wherein each of said plurality of sub-reflectors are disposed such that a major axis of each sub-reflector is aligned with a major axis of at least one other one of said plurality of sub-reflectors and a minor axis of each sub-reflector is substantially parallel with a minor axis of at least one other one of said plurality of sub-reflectors.

12. The antenna of claim 11 wherein each of said plurality of reflectors are disposed such that a major axis of each reflector is aligned with a major axis of at least one other one of said plurality of reflectors.

13. The antenna of claim 11 wherein at least some of said plurality of sub-reflectors are provided having a full elliptical shape.

14. The antenna of claim 11 wherein at least one of said plurality of sub-reflectors is provided having a having a truncated elliptical shape.

* * * * *